United States Patent [19]

Edenharter et al.

[11] 4,324,964

[45] Apr. 13, 1982

[54] DEVICE FOR EXTENDING PLUNGER DRIVES

[75] Inventors: Georg Edenharter, Vilshofen; Friedrich Ebnet, Köfering, both of Fed. Rep. of Germany

[73] Assignee: Siemens Aktiengesellschaft, Munich, Fed. Rep. of Germany

[21] Appl. No.: 135,123

[22] Filed: Mar. 28, 1980

[30] Foreign Application Priority Data

Apr. 11, 1979 [DE] Fed. Rep. of Germany ..... 2914783

[51] Int. Cl.[3] ..... H01H 3/12

[52] U.S. Cl. ..... 200/331; 200/340; 200/338

[58] Field of Search ..... 200/330, 331, 337, 338, 200/340, 153 T

[56] References Cited

U.S. PATENT DOCUMENTS 2,975,258 3/1961 Higginbottom ..... 200/330
3,239,641 3/1966 Pettit ..... 200/330
4,011,423 3/1977 Zepp ..... 200/330
4,139,756 2/1979 Tsen et al. ..... 200/331

FOREIGN PATENT DOCUMENTS 480127 11/1975 U.S.S.R. ..... 200/340

*Primary Examiner*—John W. Shepperd
*Attorney, Agent, or Firm*—Kenyon & Kenyon

[57] ABSTRACT

A device for extending the actuators of electric switchgear has an extension element which is inserted between a collar and the pushbutton of the equipment. At the end facing away from the collar, the extension element ends in C-shaped, elastically resilient arms which are fastened to the equipment by means of a snap-in connection and between which the push-button is contained. The resilient mounting of the extension element serves both for holding the element to the equipment and for restoring it after actuation. The device can be used for command equipment as well as for reset buttons such as the reset button in overload relays.

4 Claims, 5 Drawing Figures

DEVICE FOR EXTENDING PLUNGER DRIVES

BACKGROUND OF THE INVENTION

This invention relates to an actuator for extending the pushbutton of an electric switchgear. More specifically, the invention relates to an extension element which can be inserted between a control position and the pushbutton of the switchgear.

In one known arrangement for extending control plungers in actuators, cap-like extension elements which can be placed on the plunger and can be lined up in any number in a form-fitting manner, are used to bridge the gap in the assembly. This arrangement necessitates, on the one hand, a special design of the actuator so that the caps can be put on, and on the other hand, loading the return springs for the actuator drive, requiring that they be made relatively strong from the start.

SUMMARY OF THE INVENTION

Through the teachings of the present invention, a device of the above-mentioned type is provided which is a simple and inexpensive device and which extends the pushbutton without loading either the actuator or the pushbutton. This is accomplished in a simple manner by means of an extension element which ends in C-shaped elastically resilient arms and where the open side of the C extends over the pushbutton of the switchgear so that the arms can be fastened to the switchgear. The fastening of the extension element is advantageously accomplished by way of elastically resilient detent projections on the ends of the arms which can snap into openings in the switchgear. The openings can advantageously be guides for screwdriver access to terminal screws. So that pushbuttons which are flush with the equipment can be actuated with the extension element, it may also be advantageous for a contact piece, serving as a continuation of the extension element, to be formed onto the interior of the C. An easily produced, strong extension element is obtained by making the extension element of a plastic and giving it a cross-shaped cross-section. To make the extension element adaptable to the requirements of a particular job without additional manufacturing operations, the extension element is advantageously provided with dividing notches lying transverse to the longitudinal direction. Thus the extension element can be adapted, for instance, to fit the distance between a cabinet door and the pushbutton of an apparatus mounted in a switch cabinet by cutting it at the appropriate notch with a knife. The device of the invention can also be used to advantage for reset buttons in overload relays and the like, as well as for actuating command switches.

DETAILED DESCRIPTION OF THE INVENTION

Figure 1:
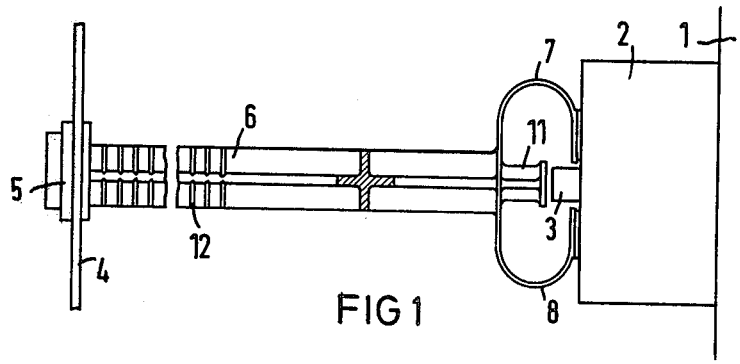
FIG. 1 is a side view of part of a switch cabinet having built-in equipment, with a control for the equipment mounted in the cabinet door and with an extension element in place.
Figure 3:
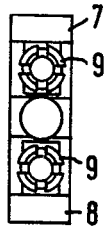
FIGS. 2 and 3 are side and end views of the extension element of the invention.
Figure 2:
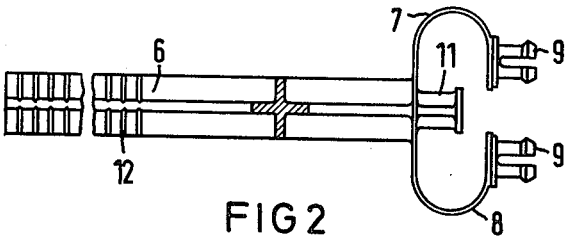
Figure 5:
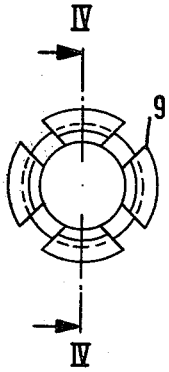
FIGS. 4 and 5 are an end view and a side view, in partial cross-section, of the fastener used on the arms of the equipment.
Figure 4:
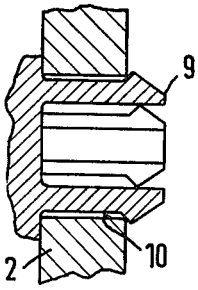

An equipment 2, which in FIG. 1 is installed on a wall 1 of a switch cabinet, is an overload relay having a reset button 3 for resetting the tripped relay. Equipment 2 is fastened to wall 1 of the switch cabinet in a manner not shown in detail, for instance, by means of bolts. On a door 4 of the switch cabinet, a collar 5 is fastened in a customary way and serves as the guide for an actuator which acts on an extension element 6 when the pushbutton portion of the actuator is pressed. Extension element 6 is a rod which ends, at the end facing away from collar 5, in elastically resilient arms 7 and 8, forming a C. Because of the C formation, elastic arms 7 and 8 constitute an open leaf spring which, being fastened, holds the extension element and serves to restore the extension element to its initial position. Arms 7 and 8 are held in place by detent projections 9 which snap into openings in equipment 2 (FIG. 4). The design of a detent projection and the way in which it fits the opening can be seen clearly in FIGS. 4 and 5. As shown in FIGS. 1 and 2, extension element 6 has a cross-shaped cross-section. The extension element ends in a projecting contact piece 11 which extends into the interior of the C and is of particular advantage when the reset buttons are flush with the front of equipment 2. As shown in FIGS. 1 and 2, divider notches 12 are provided on the length extension element 6 and make it possible to adapt the length of extension element 6 to the distance between collar 5 and reset button 3. When the actuator in collar 5 is pushed, the actuating force is transmitted, via extension element 6 and contact piece 11, to reset button 3. In the process, the elastically resilient arms 7 and 8 are deformed, being braced against the fastening points on equipment 2. When the actuator is released, it is returned to the starting position by its own restoring force and extension element 6 is also urged back into the starting position by arms 7 and 8 which spring back to their original condition. In this way, an extension is provided which does not add load to either collar 5 or pushbutton 3. Because of the cross-shaped cross-section of extension element 6, the latter is inherently twist-proof and large forces can be transmitted. The extension element can be fastened to the equipment without difficulty, without using tools any more complicated than a knife, and it can be adapted to different applications by means of the divider notches. By proper choice of material and dimensions, the arms 7 and 8 can provide any desired spring stiffness.

What is claimed is:

1. In a device for extending the point of actuation of an electric switch gear by means of an extension element which can be inserted between a point of actuation and a pushbutton of the switchgear, the improvement in which:

the switchgear is provided with at least two fastening openings, and the extension element terminates at one end in elastically resilient arms forming a C with the open side of the C extending over the pushbutton of the switchgear, and further comprising:

an elastically resilient detent projection carried on each arm, each projection adapted to snap into one of the fastening openings.

2. In a device in accordance with claim 1, the further improvement comprising:

a contact piece being formed on the interior of the C and acting as a continuation of the extension element.

3. In a device in accordance with claim 1, the further improvement comprising the extension element being made of plastic and having a cross-shaped cross-section.

4. In a device according to claim 3, the further improvement comprising the extension element having divider notches lying transversely to the length of the extension element.

* * * * *